US007204961B2

(12) United States Patent
Koide et al.

(10) Patent No.: US 7,204,961 B2
(45) Date of Patent: Apr. 17, 2007

(54) LIQUID FEED APPARATUS AND AUTOMATIC ANALYZING APPARATUS

(75) Inventors: Akira Koide, Chofu (JP); Ryo Miyake, Tsukuba (JP); Takao Terayama, Ushiku (JP); Hiroshi Mitsumaki, Mito (JP); Tomonari Morioka, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 816 days.

(21) Appl. No.: 09/259,306

(22) Filed: Mar. 1, 1999

(65) Prior Publication Data

US 2002/0012614 A1 Jan. 31, 2002

(30) Foreign Application Priority Data

Mar. 4, 1998 (JP) ..... 10-051760

(51) Int. Cl.

| | |
|---|---|
| ***B01L 3/02*** | (2006.01) |
| ***G01N 1/10*** | (2006.01) |
| ***F04B 23/06*** | (2006.01) |
| ***F16K 16/00*** | (2006.01) |
| ***F16K 7/07*** | (2006.01) |

(52) U.S. Cl. ..... 422/103; 100/102; 417/413.1; 436/180; 137/872; 137/885

(58) Field of Classification Search ..... 422/63, 422/64, 67, 100, 103, 104, 102; 436/43, 436/47, 49, 54, 180; 417/413.2, 413.3, 413.1; 251/129.06, 11; 137/872, 855, 885
See application file for complete search history.

(56) References Cited

U.S. PATENT DOCUMENTS 4,152,098 A * 5/1979 Moody et al. ..... 417/413
4,581,624 A * 4/1986 O'Connor ..... 357/26
4,596,242 A * 6/1986 Fischell ..... 417/413
4,844,868 A * 7/1989 Rokugawa ..... 422/64
4,895,500 A * 1/1990 Hok et al. ..... 417/566
5,085,562 A * 2/1992 Van Lintel ..... 417/413
5,171,132 A * 12/1992 Miyazaki et al. ..... 417/413
5,205,819 A * 4/1993 Ross et al. ..... 604/67
5,224,843 A * 7/1993 Van Lintel ..... 417/413 A (Continued)

FOREIGN PATENT DOCUMENTS

DE 41 39 668 A1 6/1993

(Continued)

*Primary Examiner*—Brian R. Gordon
(74) *Attorney, Agent, or Firm*—Antonelli, Terry, Stout & Kraus, LLP.

(57) ABSTRACT

Provided is a liquid feed apparatus for feeding liquid by operating a diaphragm at a high frequency, in which an inlet valve and an outlet valve are integrally incorporated with a liquid feed chamber, the positions of the valve are shifted into peripheral parts of the liquid feed chamber so as to allow fluid to smoothly flow from the inlet to the outlet in order to prevent air bubbles from causing pressure fluctuation during liquid feed, from remaining in the liquid feed chamber. Further, the valve has a center beam structure in which a protrusion having a height greater than several micron meters, is formed in the seat part of the valve so as to deform a center beam for pressurizing the valve in order to enhance the shut-off ability of the valve, and the center beam has a small surface area in the direction of displacement of the valve.

11 Claims, 5 Drawing Sheets

U.S. PATENT DOCUMENTS

| | | | | |
|---|---|---|---|---|
| 5,529,465 | A * | 6/1996 | Zengerle et al. | 417/413.2 |
| 5,542,821 | A | 8/1996 | Dugan | |
| 5,585,011 | A * | 12/1996 | Saaski et al. | 216/2 |
| 5,759,014 | A * | 6/1998 | van Lintel | 417/413.3 |
| 5,785,295 | A * | 7/1998 | Tsai | 251/11 |
| 6,033,191 | A * | 3/2000 | Kamper et al. | 417/322 |

FOREIGN PATENT DOCUMENTS

| | | |
|---|---|---|
| DE | 44 33 894 A1 | 3/1996 |
| JP | 03233177 | 10/1991 |
| JP | 3112588 | 11/1991 |
| JP | 434476 | 3/1992 |
| JP | 06341376 | 12/1994 |
| JP | 08114601 | 5/1996 |
| JP | 10061558 | 3/1998 |
| WO | WO91/07591 | 5/1991 |
| WO | WO-9519502 A1 * | 7/1995 |

* cited by examiner 135
123
120
121

122
111
110

143
132'
122
123
131
140
111
121

140
143

130
123'
134
133

LIQUID FEED APPARATUS AND AUTOMATIC ANALYZING APPARATUS

BACKGROUND OF THE INVENTION

The present invention relates to a liquid feed apparatus, in particular to a liquid feed apparatus using a micropump for feeding liquid at a flow rate of several micron litters to several hundred micron litters per second, and also relates to an automatic analyzing apparatus using the liquid feed apparatus.

A micropump has been already known as disclosed in PCT Application WO91/07591. This micropump is composed of three chambers, that is, an inlet valve chamber, and a liquid feed chamber and an outlet valve chamber. Further, the position of an inlet through which fluid flows into the liquid feed chamber is shifted from the center to the peripheral part of the liquid feed chamber so as collect air bubbles on the opposite side where the inlet port is present, within the liquid feed chamber, and an orifice serving as an outlet port is provided in the part in order to remove the air bubbles therethrough. With this arrangement, air bubbles can be efficiently removed from the liquid feed chamber. Further, in order to enhance the shut-off ability of a valve, a thin membrane is formed in a seat part of a diaphragm type valve so as to enhance the close contact between a valve and a valve port.

However, in the structure of the above-mentioned pump, even though air bubbles can be removed from the liquid feed chamber, air bubbles cannot be removed from the outlet valve chamber downstream of the outlet orifice of the liquid feed chamber, that is, it is difficult to completely eliminate affection upon the discharge characteristic of the pump by air bubbles. Further, since the liquid feed apparatus is composed of three chambers, the size in a plan view thereof becomes inevitably large, and accordingly, it is difficult to reduce the cost thereof. The shut-off ability of the valve is enhanced by pressurizing the diaphragm type valve. Accordingly, the operation of the diaphragm type valve at a high frequency is difficult due to a resistance of liquid applied to the diaphragm, and accordingly, the discharge flow rate can hardly be increased up to several hundred micron litters per second.

OBJECT AND SUMMARY OF THE INVENTION

An object of the present invention is to provide a micropump which can eliminate affection upon the discharge characteristic of the pump by air bubbles and which can be operated at a high frequency with a simple structure. Further, with the use of the micropump in a reagent supply part of an automatic analyzing apparatus which can therefore supply reagent with a high degree of accuracy.

According to the present invention, liquid inlet and outlet ports are formed in a one an the same plane, and the positions of the inlet and outlet ports are shifted from the center to the peripheral part of the liquid feed chamber so as to allow air bubbles to smoothly flow from the inlet to the outlet in order to prevent the air bubbles from remaining in the liquid feed chamber, thereby it is possible to eliminate a problem of occurrence of pressure fluctuation in the liquid feed chamber during liquid feed. Further, a valve having a center beam structure having a small surface area in a displacement direction is provided in each of the inlet and outlet of the liquid feed chamber. A protrusion having a height higher than several micron meters is formed in the seat part of the above-mentioned valve so as to deform the center beam in order to pressurize the valve thereby the shut-off ability thereof is enhanced, and further, with the provision of the center beam valve structure, the resistance of peripheral fluid is decreased to improve the frequency response.

BRIEF DESCRIPTION OF THE DRAWINGS

FIG. 8*d* is a perspective view illustrating an outlet valve substrate in the apparatus shown in FIG. 8*a*.

DESCRIPTION OF THE PREFERRED EMBODIMENTS

Figure 1:
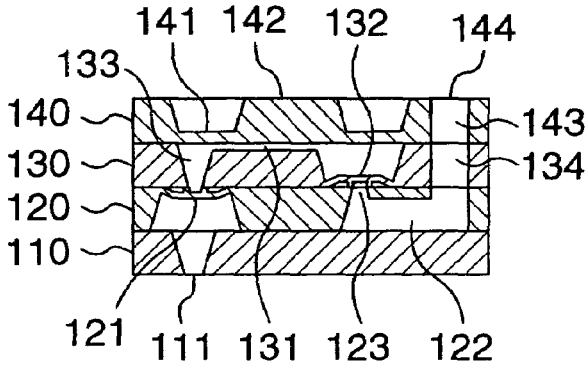
FIG. 1 is a sectional view illustrating first and second embodiments of the present invention.
Figure 2:
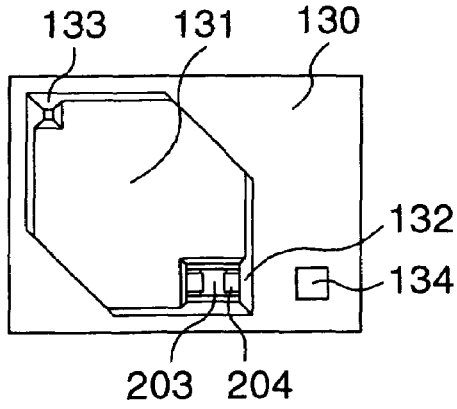
FIG. 2 is a plan view illustrating a liquid feed chamber substrate in the first embodiment of the present invention.

Referring to FIG. 1 which is a sectional view illustrating a liquid feed apparatus in a first embodiment of the present invention, and FIG. 2 which is a plan view illustrating a liquid feed chamber in the liquid feed apparatus in the first embodiment, the liquid feed apparatus is composed of four pieces, that is, a discharge nozzle substrate 110, an outlet valve substrate 120 provided on the discharge nozzle substrate 110, a liquid feed chamber substrate 130 provided on the outlet valve substrate 120, and a diaphragm substrate 140 provided on the liquid feed chamber substrate 110. The discharge nozzle substrate 110 is formed therein a discharge nozzle 111, and the outlet valve substrate 120 is formed therein with an outlet valve 121 and an inlet passage 122 and an inlet port 123. The liquid feed chamber substrate 130 is formed therein with a liquid feed chamber 131, an inlet valve 132, an outlet port 133 and an inlet passage 134. The diaphragm substrate 140 is formed therein with a diaphragm 141, a rigid body part 142, an inlet passage 143 and an inlet 144.

Explanation will be hereinbelow made of a liquid feed procedure for the above-mentioned liquid feed apparatus.

First, in order to displace gas in the liquid feed chamber 131 in the liquid feed apparatus with liquid, a liquid introducing device (which is not shown) for feeding liquid to be introduced is connected with the inlet 144 of the liquid feed apparatus. When the liquid is pressurized and fed into the inlet 144 from the liquid introducing device, the pressurized liquid comes to the inlet valve 132 through the liquid passages 143, 134, 122, and accordingly, the inlet valve 132 is opened by the pressure of the liquid so that the liquid flows into the liquid feed chamber 131 from the inlet. In this phase, should the liquid flows spontaneously into a planar passage underneath the diaphragm 141 under surface tension, it would be required that the liquid by a flow rate which is larger than that of the liquid flowing through the planar passage is fed into the liquid feed chamber 131 from the liquid introducing device.

When the liquid flows into from the inlet, the gas which is present in the inlet part is driven into the planar passage by the liquid, and accordingly, the inlet part is filled with the liquid. In such a case that the liquid does not flow into the planar passage underneath the diaphragm 141 by itself, the flow rate of the liquid from the liquid introducing device may be arbitrary. In this case the gas is driven from the inlet side and into the outlet by the liquid fed by the liquid introducing device, and accordingly all the gas is driven out from the liquid feed chamber 131. When the liquid feed chamber 131 is filled with the liquid, the liquid introducing device at the inlet 144 is replaced with a container which contains fluid to be discharged, the container being connected with the inlet 144. Thus, the preparation for the liquid feed is completed.

It is noted that the above-mentioned replacement can be similarly made by such a way that a vacuum pump is connected to the discharge nozzle 111 while the container which contains fluid (liquid) to be discharged is connected to the inlet 144 in order to replace the gas in the liquid feed chamber 131 with the liquid. When the gas in the liquid feed apparatus is sucked out from the discharge nozzle 111 by the vacuum device, the back pressure in the outlet valve 121 becomes lower than the internal pressure of the liquid feed chamber 131 so that the outlet valve is opened, and accordingly, the gas is sucked out from the liquid feed chamber 131. Thus, the pressure in the liquid feed chamber 131 becomes lower than that of the inlet port 123 so that the inlet valve 132 is opened, and accordingly, the gas in the inlet passages 122, 134, 143 is sucked into the liquid feed chamber 131.

As a result, the fluid flows from the container into the inlet passages 122, 134, 143, and then comes to the inlet valve 132. Under continuous suction by the vacuum pump, the liquid flows into the liquid feed chamber 131 through the inlet after opening the inlet valve 132, similar to the gas as mentioned above. In this phase, should the liquid spontaneously flow into the planar passage underneath the diaphragm 141 under surface tension, it would be required that the liquid is sucked up by the vacuum pump by a flow rate which is larger than the flow rate at which the liquid flows in the planar passage so as to fill the liquid feed chamber 131 with the liquid. Thus, the gas in the inlet part is driven into the planar passage by the liquid so that the inlet part is filled with the liquid.

Further, in such a case that the fluid do not flow into the planar passage underneath the diaphragm by itself, the suction force of the vacuum pump may be set to be arbitrary. In this case, the gas is driven out from the inlet into the outlet by the liquid sucked into by the vacuum pump, and accordingly, all the gas is driven out from the liquid feed chamber 131.

When the liquid feed chamber is filled with the liquid, the vacuum pump is disconnected from the discharge nozzle 111, and accordingly, the preparation of liquid feed is completed. Next, the liquid feed procedure will be explained.

First, when the diaphragm 141 is pushed into the liquid feed chamber 131 by an actuator, the volume of the liquid feed chamber 131 is decreased, and accordingly, the liquid by a volume corresponding to a value by which the volume of the liquid feed chamber 131 is decreased, flows from the liquid feed chamber 131 through the outlet port 133 after it forcibly opens the outlet valve 121, and is then discharged from the discharge nozzle 111. Next, when the actuator is driven so as to deform the diaphragm 141 in a direction in which the volume of the liquid feed chamber 141 is increased, the fluid flows into the liquid feed chamber 131 through the inlet port 123 by a volume corresponding to the value by which the volume of the liquid feed chamber 131 is increased, after it forcibly opens the inlet valve 132. With the repetitions of these steps, the liquid feed is carried out.

There are three features in this embodiment. That is, In the first feature, the liquid feed chamber 131, the inlet valve 132 and the discharge port 133 are formed in one and the same liquid feed chamber substrate 130. It is noted that the inlet valve 132 is composed of a seat part 203 and a beam part 204. With this arrangement, the dead volume from the inlet to the discharge nozzle can be decreased to a small value, and accordingly, the volume of fluid to be displaced at one time can be decreased. As a result, the inertial force of the fluid can be minimized, and accordingly, the frequency response can be improved. Further, the liquid feed chamber can be integrally molded so that a height difference structure, that is, a stepped structure or the like which causes sticking of air bubbles can be eliminated, thereby it is possible to prevent the air bubbles which would deteriorate the frequency response from remaining in the liquid feed chamber.

In the second feature, the liquid feed chamber 131 has a flow passage shape, and the outlet and inlet ports 132, 133 are located at the opposite ends thereof. With this arrangement, when the liquid having flown into through the inlet valve 132 flows in such a flow passage shape liquid feed chamber, the gas can be driven automatically toward the outlet 133, thereby it is possible to facilitate the removal of air bubbles.

Figure 3:
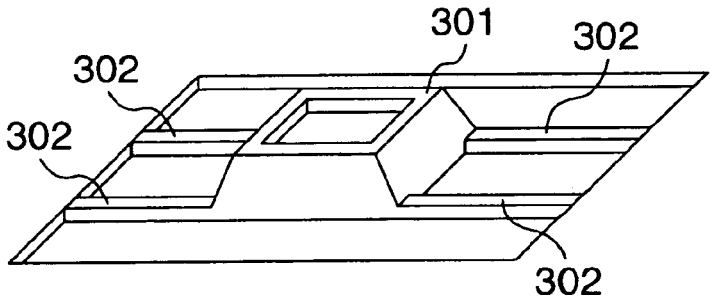
FIG. 3 is a perspective view illustrating a valve structure according to the present invention.

FIG. 3 shows the valve part formed in the liquid feed chamber substrate 130 or the outlet valve substrate 120, in detail.

In the third feature, the protrusion of the valve seat part 301 is integrally molded with the valve through silicon processing so that the protrusion can be formed into the one which has a large height difference and which is highly durable. Thus, the height of the valve seat part 301 can be optionally set so as to control the close contact between the valve and the valve port in order to enhance the shut-off ability of the valve in accordance with its use, thereby it is possible to improve the frequency response. Further, the valve seat part 301 is supported by beams 302 having a small surface area in the direction of displacement of the valve so as to reduce the resistance of peripheral fluid during displacement of the valve, thereby it is possible to further enhance the frequency characteristic of the valve. The valve seat part 301 presses against the inlet or outlet when the center beams are elastically deformed. It is noted that although the center part of the protrusion of the valve seat part 301 of the valve shown in FIG. 3, is gouged out, the peripheral part thereof may be tapered in order to take an advantage such that stress concentration upon contact with liquid feed chamber substrate or the outlet valve substrate can be relieved. Further, although the beams 302 and the substrate have the same thickness, the thickness of the beams may be decreased in thicknesswise direction so as to have a low height difference structure with respect to the substrate. Thereby it is possible to give an advantage that it is possible to prevent from floating of a protecting film which is usually applied on the substrate.

Figure 4:
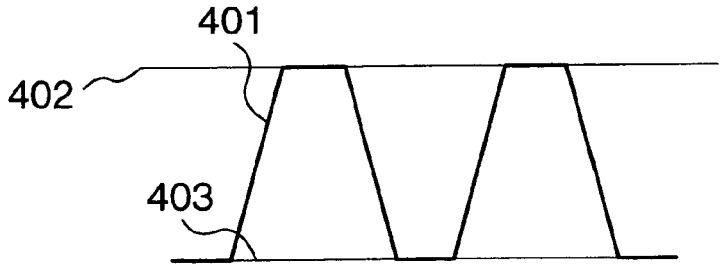
FIG. 4 is a view illustrating a waveform for driving a diaphragm according to the present invention.

The waveform for driving the diaphragm during the liquid feed is shown in FIG. 4, and has a shape which is not a sinusoidal shape by which the diaphragm is continuously deformed, but has such a shape that the deformed condition of the diaphragm is held for a while when it is deformed maximumly. With this arrangement, during a period in which the deformation of the diaphragm is interrupted, both the inlet valve and the outlet valve can be completely closed, thereby it is possible to enhance the shut-off ability of the valves.

Figure 5:
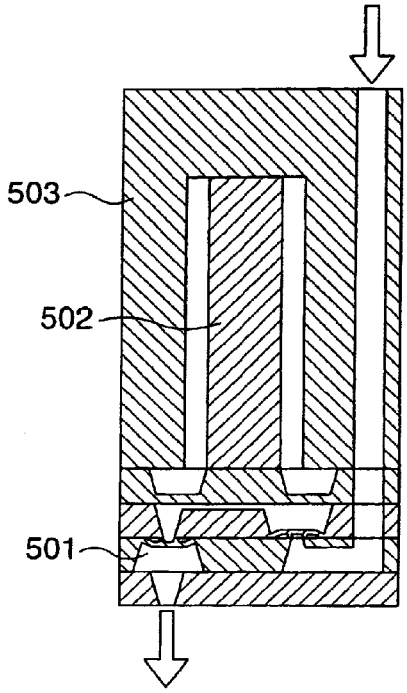
FIG. 5 is a sectional view illustrating a mount structure according to the present invention.

FIG. 5 shows an example of a means for driving the diaphragm when the liquid feed apparatus is operated. This driving means is composed of a laminated piezo-electric element 502 for driving the diaphragm. The laminated piezo-electric element 502 is secured to the diaphragm 141 by a casing 503. Further, the casing 503 is secured thereto with a pump 501, and the casing 503 is secured thereto with the laminated piezo-electric element 502 while the laminated piezo-electric element 502 and the rigid body part 142 of the pump 501 are secured together.

Figure 6A:
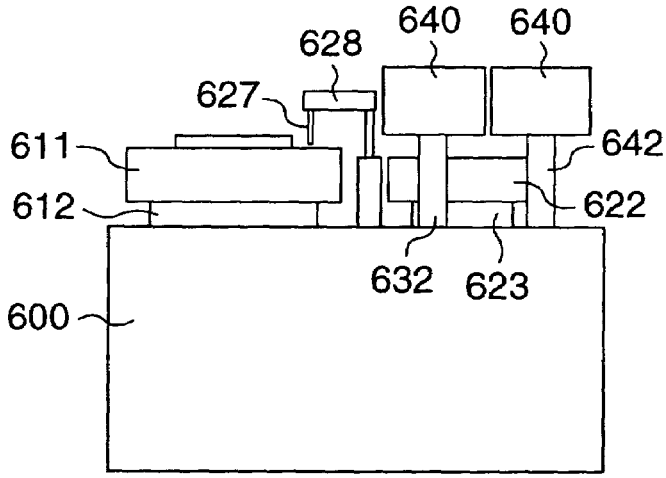
FIG. 6*a* is an elevation view illustrating an automatic analyzing apparatus to which the liquid feed apparatus according to the present invention is applied.
Figure 6B:
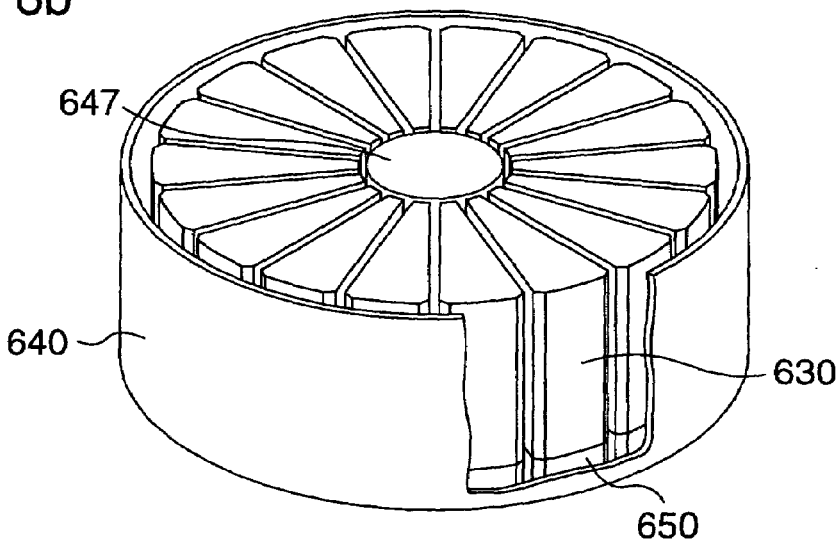
FIG. 6*b* is a perspective view illustrating a reagent supply part used in the analyzing apparatus shown in FIG. 6*a;*
Figure 6C:
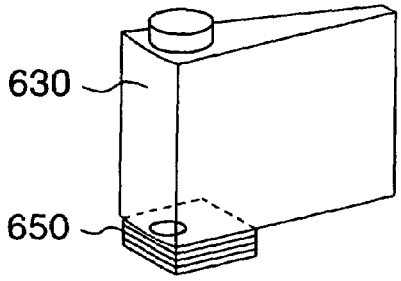
FIG. 6*c* is a perspective view illustrating a reagent holder used in the reagent supply part shown in FIG. 6*b;*
Figures 8A, 8B, 8C, 8E:
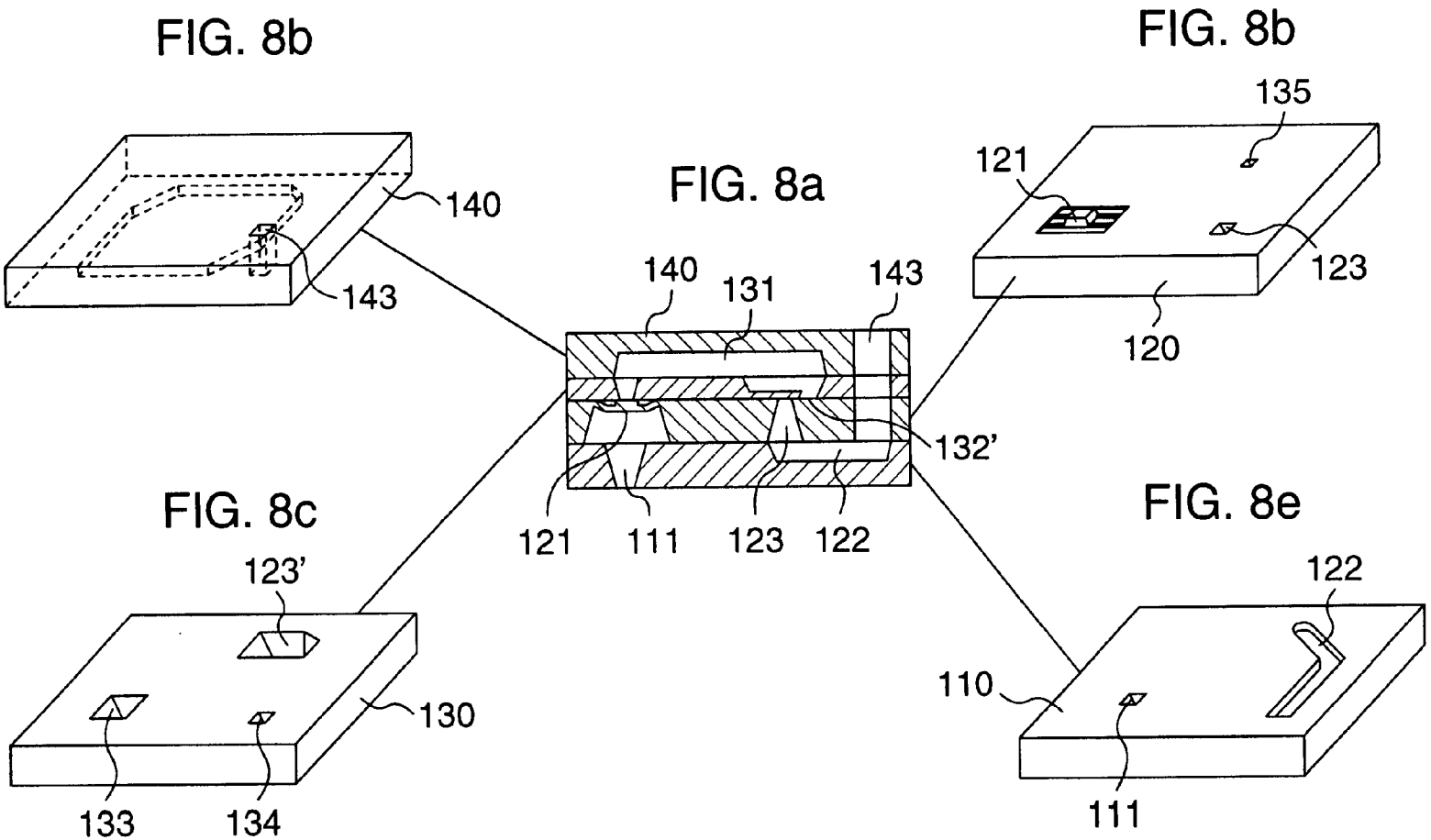
FIG. 8*a* is a sectional view illustrating a liquid feed apparatus in a third embodiment of the present invention.
FIG. 8*b* is a perspective view illustrating a diaphragm substrate in the apparatus shown in FIG. 8*a;*
FIG. 8*c* is a perspective view illustrating a liquid feed chamber substrate in the apparatus shown in FIG. 8*a;*
FIG. 8*e* is a perspective view illustrating a discharge nozzle substrate in the apparatus shown in FIG. 8*a.*

FIGS. 6*a* to 6*e* show an example of a mounting arrangement in which the liquid feed apparatus according to the present invention is applied to an automatic analyzing apparatus. FIG. 6*a* shows the entire arrangement of the automatic analyzing apparatus, and FIG. 6*b* shows a reagent supply part in details, and FIG. 6*c* shows a reagent container provided with a reagent liquid feed apparatus.

In this automatic analyzing apparatus, a sample of blood plasma is reacted with an agent so as to check a health status, and the liquid feed apparatus according to the present invention is applied for metering discharge of the reagent adapted to be reacted with the sample of blood plasma.

As shown in FIG. 6*a*, the automatic analyzing apparatus 600 is composed of a sample container holder 611 which can accommodate therein more than one of sample containers each containing therein a sample to be measured, a sample container holder rotating drive mechanism 612 for moving the sample containers accommodated in the sample container holder 611 to a sample sucking position, a reaction container holder 623 which can accommodate more than one of a reaction containers each receiving a sample and more than one kinds of reagents so as to react them with each other, a reaction container holder rotating drive mechanism 622 for moving the reaction container accommodated in the reaction container holder 623 to a sample discharge position, a first reagent discharge position, and to a second reagent discharge position, successively, a sample pipetter 628 adapted to insert a nozzle into a sample container which has been moved to the sample sucking position so as to suck up a sample therein, for pipetting the same by a required quantity into a reaction container which has been moved to the sample discharge position, and a sample pipetter washing mechanism (which is not shown). Further, the reaction container holder 623 is provided with a thermostatic oven for maintaining the samples and the reagents in the reaction containers at a constant temperature. Further, the automatic analyzing apparatus is composed of first reagent containers 630 containing therein a first reagent coping with a measuring item, a first reagent container holder 640 which can accommodate therein more than one of the first reagent containers 630, and a first reagent container holder rotating drive mechanism 632 for moving the first reagent containers 630 accommodated in the first reagent holder 640 to the first reagent discharge position, a first reagent pump unit 650 for pipetting the first reagent into a reaction container containing a sample at the first reagent discharge position from a first reagent container 630 which has been moved to the first reagent discharge position, and a second reagent holder which has the same structure as that of the first reagent container holder as shown in this figure, and in which a second reagent is held. It is noted that this reagent container holder 640 has a bearing structure 647 which can be simply installed on and removed from a shaft of the holder rotating mechanism 632 (refer to FIG. 6*b*).

It is noted that an agitating mechanism which is not shown, for mixing a sample and at least one kind of reagent contained in the reaction container is provided around the reaction container holder. Further, the automatic analyzing apparatus is composed of an optically spectroscopic measurement part for measuring a variation in absorbancy due to reaction between a sample and more than one kinds of reagents contained in a reaction container, and a reaction container washing mechanism for washing a reaction container for which the optically spectroscopic measurement is completed.

In this example, the liquid feed apparatus 650 is directly attached to a reagent container 630 in which a reagent is contained so as to discharge the reagent directly from the reagent container (refer to FIG. 6*c*). Thus, with the provision of the liquid feed apparatus which has been explained in the abovementioned embodiment, to the reagent container 630, no reagent supply device which has been conventionally incorporated is required, thereby it is possible to aim at making the analyzing apparatus small-sized, to prevent different reagents from being mixed by the reagent supply device, to prevent occurrence of inferior liquid feed caused by air bubbles, and to supply a reagent with a high degree of accuracy. Thus, the analysis can be made with a high degree of accuracy.

Figure 7:
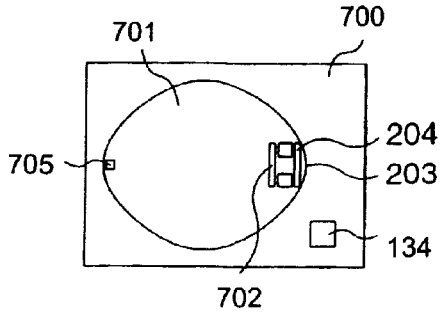
FIG. 7 is a plan view illustrating a liquid feed chamber substrate in a second embodiment of the present invention.

Referring to FIG. 7 which is a plan view illustrating a liquid feed chamber in a second embodiment, the liquid feed apparatus is composed of components similar to those shown in FIG. 1. In this embodiment, like reference numerals are use to denote components like to those shown in FIG. 1. An arrangement which is different from the arrangement shown in FIG. 1 is such that the peripheral shape of the liquid feed chamber has a curve having a predetermined curvature. Except this fact, the structure and the operation thereof are the same as those which have been explained with reference to FIG. 1. Accordingly, detailed description thereto will be omitted for the sake of brevity.

The features of this embodiment will be hereinbelow made.

In the first feature, the liquid feed chamber 131, the inlet valve 132 and the discharge port 133 are formed in one and the same liquid feed chamber substrate With this arrangement, the dead volume from the inlet to the outlet nozzle can be made to be small, the volume of fluid which is conveyed at one time becomes small so that the inertia force of the fluid can be minimized, thereby it is possible to enhance the frequency response. Further, the liquid feed chamber can be integrally molded so as to eliminate a height difference structure and the like causing sticking of air bubbles, thereby it is possible to prevent air bubbles which hinders the frequency response from remaining in the liquid feed chamber.

in the second feature, the shape of the liquid feed chamber 701 has a passage shape having inlet and outlets 702, 705 at opposite ends thereof. The liquid feed chamber 701, the inlet 702 and the outlet 705 are formed in one and the same liquid feed chamber substrate 700. With this arrangement, when liquid having flown from the inlet 702 flows in the passage shape liquid feed chamber, gas can be spontaneously driven toward the outlet 705, thereby it is possible to facilitate the removal of air bubbles.

It is noted that the structures of the valve seat part and the like are the same as those explained in the first embodiment, and further, the technical effects and advantages thereof are the same as those explained in the first embodiment. Further, it goes without saying that this embodiment can also applied to the automatic analyzing apparatus shown in FIG. 6.

Referring to FIG. 8*a* to 8*e*, explanation will be made of another embodiment of the liquid feed apparatus according to the present invention. This embodiment has the same structure as that shown in FIG. 1, except that a cantilever beam valve 132' is used as the valve on the inlet port 123' side of the liquid feed chamber, through which liquid flows into the liquid feed chamber 131, and that the inlet port of the liquid feed chamber is formed of a cut-out having a size larger than that of the valve 132'. It is noted that the structure of the valve on the outlet side is the same as that shown in FIG. 1. That is, the valve is closed by being pressurized by a center beam. The other structure is substantially the same as that shown in FIG. 1, and accordingly, detailed description will be omitted for the sake of brevity.

The reason why one of the two valves provided in the liquid feed chamber has a cantilever beam type, is such that a predetermined volume of liquid can be fed out with a high degree of accuracy if the shield ability of either one of the valve is satisfactory although the cantilever beam valve has a shield ability which is low more or less in comparison with the center beam type valve, thereby it is possible to facilitate the manufacture of the liquid feed apparatus. Further, the reason why the inlet side of the liquid feed chamber has a cutout, is such that liquid can be smoothly developed in the liquid feed chamber even though it is mingled therein with air bubbles, and accordingly, the air bubbles can be surely bled. It is natural that the valve in the inlet side of the liquid feed chamber can completely cover the inlet port 123 formed in the outlet valve substrate 120 although it does not completely cover the cutout, and no particular problem occurs. Further, it goes without saying that a valve having a cantilever beam type may be provided on the outlet side of the liquid feed chamber while a valve having a center beam type is provided on the inlet side thereof.

As mentioned above, the liquid feed apparatus according to the present invention can prevent air bubbles from remaining in the liquid feed chamber, thereby it is possible to drive the diaphragm at a high frequency, and a desired volume of liquid can be fed with low power consumption. Further, with the provision of the liquid feed apparatus according to the present invention in an automatic analyzing apparatus, analysis can be made with a high degree of accuracy.

What is claimed is:

1. A liquid feed apparatus comprising a liquid feed chamber having an inlet port and one outlet port and having a variable volume, and a deformable diaphragm constituting at least one of side surfaces defining said liquid feed chamber, said diaphragm being deformed in a direction in which the volume of said liquid feed chamber increases, so as to introduce fluid into said liquid feed chamber through said inlet port, and said diaphragm being deformed in a direction in which the volume of said liquid feed chamber decreases, so as to discharge the fluid through said outlet port, said liquid feed chamber being provided in the inlet port with a valve for decreasing a resistance of fluid flowing into from the outside, and in the outlet port with a valve located for decreasing a resistance of fluid flowing out to the outside, but increasing a resistance of fluid flowing into from the outside, said liquid feed chamber has a peripheral part circumscribing the liquid feed chamber, the outlet port is formed at said peripheral part of the liquid feed chamber, said valves provided in the inlet port and said outlet port are molded integrally through silicon processing in a liquid feed chamber substrate formed therein with said liquid feed chamber, and each of said valves is composed of a valve seat part and resiliently deformable beams integrally incorporated with the valve seat part so that the valve seat part is pressed against the associated inlet or outlet port by a force exerted by the beams resiliently deformed, the valve seat part is displaceable to and from the associated inlet or outlet port.

2. A liquid feed apparatus as set forth in claim 1, wherein at least one of the valves provided in said inlet and said outlet, is a center beam structure, and a center beam is attached so as to be elastically deformed such that said valve seat part of the valve is projected from support parts on opposite ends of the valve, and the seat part of said valve presses against the inlet or the outlet when said center beam is elastically deformed.

3. A liquid feed apparatus as set forth in claim 1, wherein either one of valves on said inlet port and on said outlet port is a cantilever beam type, and the other one of them is a center beam type, and a center beam of the center beam type valve is attached so as to be elastically deformed such that a seat part of said valve is projected from support parts at opposite ends of said valve, and said seat part of said valve presses against said inlet port or said outlet port when the center beam is elastically deformed.

4. A liquid feed apparatus as set forth in claim 1, wherein said liquid feed chamber incorporates the inlet port and the outlet port which are formed in one of the surfaces opposed to the diaphragm and which are opposed to the diaphragm, the outlet port being located at the other end of the liquid feed chamber[, and having an inclined surface communicating between the one surface and the outlet port].

5. A liquid feed apparatus as set forth in claim 1, wherein the seat part is supported by a plurality of beams.

6. A liquid feed apparatus comprising:

a liquid feed chamber having a space through which fluid flows;

an inlet port through which fluid is fed into the liquid feed chamber;

an outlet port through which the fluid is discharged from the liquid feed chamber;

a deformable diaphragm formed in one of surfaces defining the liquid feed chamber, said diaphragm being deformed in a direction in which the space of said liquid feed chamber increases its volume so as to introduce the fluid into the liquid feed chamber from the outside through said inlet port, said diaphragm being deformed in a direction in which the space of said liquid feed chamber decreases its volume so as to discharge the fluid from the liquid feed chamber to the outside through said outlet port;

an inlet valve provided in the inlet port and effecting a first resistance when fluid flows into the liquid feed chamber from the outside, but a second resistance higher than the first resistance when fluid flows out from the liquid feed chamber, and an outlet valve provided in the outlet port and effecting a third resistance when fluid flows out from the liquid feed chamber, but a fourth resistance higher than the third resistance when fluid flows into the liquid feed chamber from the outside;

at least one of the inlet valve and the outlet valve being composed of a seat part formed opposed to the associated inlet or outlet port, and a resiliently deformable beam supporting the seat part, the beam being resiliently deformed when the valve is closed, so that the beam presses the seat part against the associated inlet or outlet port through its resilient deformation.

7. A liquid feed apparatus as set forth in claim 6, wherein the inlet port and the outlet port are formed in a surface opposed to the diaphragm.

8. A liquid feed apparatus as set forth in claim 6, wherein said liquid feed chamber incorporates the inlet port and the outlet port which are formed in one of the surfaces opposed to the diaphragm and which are opposed to the diaphragm, the outlet port being located at the other end of the liquid feed chamber.

9. A liquid feed apparatus as set forth in claim 6, wherein the seat part is supported by a plurality of beams.

10. A liquid feed apparatus comprising:

a liquid feed chamber having a space through which fluid flows from one end to the other end of the liquid feed chamber;

an inlet port through which fluid is fed into the liquid feed chamber;

an outlet port through which the fluid is discharged from the liquid feed chamber;

a deformable diaphragm formed in a first one of surfaces defining the liquid feed chamber, said diaphragm being deformed in a direction in which the space of said liquid feed chamber increases its volume so as to introduce the fluid into the liquid feed chamber from the outside through said inlet port, said diaphragm being deformed in a direction in which the space of the said liquid feed chamber decreases its volume so as to discharge the fluid from the liquid feed chamber to the outside through said outlet port;

an inlet valve provided in the inlet port and effecting a first resistance when fluid flows into the liquid feed chamber from the outside, but a second resistance higher than the first resistance when fluid flows out from the liquid feed chamber, and an outlet valve provided in the outlet port and effecting a third resistance when fluid flows out from the liquid feed chamber, but a fourth resistance higher than the third resistance when fluid flows into the liquid feed chamber from the outside, said liquid feed chamber incorporating the inlet port and the outlet port which are formed in a second one of the surfaces opposed to the diaphragm and which are opposed to the diaphragm, the outlet port being located in the other end of the liquid feed chamber.

11. A liquid feed apparatus as set forth in claim 10, wherein said second surface has a thick wall zone and a thin wall zone, and said outlet port is formed in the thin wall zone.

* * * * *